US005168862A

United States Patent [19]

McGee

[11] Patent Number: 5,168,862

[45] Date of Patent: Dec. 8, 1992

[54] FIREPLACE THROAT AND PROCESS

[75] Inventor: Donald R. McGee, Monroe, N.C.

[73] Assignee: McGee Brothers Company, Inc., Monroe, N.C.

[21] Appl. No.: 706,972

[22] Filed: May 29, 1991

[51] Int. Cl.[5] ..... F24B 1/18

[52] U.S. Cl. ..... 126/500; 126/8; 126/144; 126/147; 33/518; 33/DIG. 9; 52/218; 52/741.1

[58] Field of Search ..... 126/500, 8, 144, 151, 126/147; 52/747, 741, 741, 744; 33/18.1, 213, 26, 403, 423, 452, 518, DIG. 9, DIG. 20

[56] References Cited

U.S. PATENT DOCUMENTS

| | | | |
|---|---|---|---|
| 3,301,249 | 1/1967 | Hendricks | 126/500 X |
| 3,420,020 | 1/1969 | Keppelman | 126/500 X |
| 3,466,000 | 9/1969 | Southern | 126/500 X |
| 3,721,225 | 3/1973 | Tidwell | 126/500 X |
| 4,422,438 | 12/1983 | Scholz et al. | 126/500 |

*Primary Examiner*—Larry Jones
*Attorney, Agent, or Firm*—Clifton Ted Hunt

[57] ABSTRACT

A clay throat with a smooth inner surface is provided for a brick fireplace, and a template and process are described for cutting clay flue liners into selected portions for assembly and joining into the configuration of the clay fireplace throat at the site of the fireplace.

11 Claims, 5 Drawing Sheets

FIREPLACE THROAT AND PROCESS

FIELD OF THE INVENTION

This invention relates to fireplaces and more specifically to the use of clay flue liners to line the throat of a brick fireplace. As used herein, the term "clay throat" means a fireplace throat lined with portions of clay flue liners.

BACKGROUND OF THE INVENTION

Brick fireplaces have been conventionally built entirely from brick with a clay flue liner. Brick has been used to form the firebox and the throat of the fireplace. The throat, or smoke chamber as it is sometimes known, tapers inwardly and upwardly from the firebox to the relatively small tubular clay flue liner extending through the chimney.

Fireplaces come in all sizes but the cross-sectional dimensions of the firebox is always larger than those dimensions of the flue of a fireplace One function of the throat in a fire-place is to gradually reduce the cross-sectional dimensions of the area between the firebox and the flue of a fireplace.

A conventional fireplace may have, for example, a brick firebox measuring 29 inches (73.7 cm) wide by 20 inches (50.8 cm) deep and a clay flue liner measuring 9 inches (22.9 cm) deep and 13 inches (33 cm) wide. The brick throat provides a transition between these two sets of dimensions. The prior art process of making the throat from brick requires a lot of brick to fill in the space between the firebox and the relatively small flue. Installation of the brick is time consuming to the point that the making of a brick throat accounts for a significant amount of the overall cost of a brick fireplace.

The cost of a conventional brick fireplace has been instrumental in the development of what are known as prefabricated fireplaces. Prefabricated fireplaces are less expensive than conventional brick fireplaces because they are usually smaller and because they use less expensive materials which are not as rugged and long lasting as brick. The firebox and throat of a prefabricated fireplace are typically made from a frangible refractory lining.

The economy of lining the fireplace throat with selected pieces of clay flue liner instead of an otherwise all-brick fireplace reduces the cost of brick fireplaces to be competitive with prefabricated fireplaces while retaining the advantageous efficiency and durability of the all-brick fireplace.

SUMMARY OF THE INVENTION

The fireplace throat of this invention is lined with selected pieces of conventional clay flue liners which are routinely delivered to the site while a brick fireplace is being built. The clay flue liners are made in different cross-sectional dimensions but are uniformly about two feet (30.5 cm) in length.

Templates have been designed for marking selected lines of cut on the conventional clay flue liners. The templates are placed against the clay flue liners to provide a pattern for selected lines of cut and the clay flue liners are marked to indicate the lines of cut. A masonry saw is used to cut the clay flue liners along the selected lines of cut and selected pieces of the clay flue liners are assembled in the desired configuration of the throat and installed with mortar on top of the firebox to line the throat of the fireplace. The flue liner and chimney are built up from the throat in the usual way to complete the fireplace.

BRIEF DESCRIPTION OF THE DRAWINGS

FIG. 20 is a side view of the clay flue liner shown in FIG. 19, showing with hatching the part of the third clay flue liner that has been cut away and removed;

DETAILED DESCRIPTION OF THE INVENTION

Brick fireplaces are, of course, constructed on site and it is common practice to deliver a plurality of preformed clay flue liners of selected sizes to the site of the fireplace. Flue liners having a rectangular cross-section and measuring 9×13×24 inches (22.9×33×61 cm) are typical. Square flue liners measuring 13×13×24 inches (33×33×61 cm) are also typical. These dimensions are used in the illustrated embodiments of the invention for purposes of illustration, but the dimensions of the clay flue liners are not critical. However, clay flue liners used for lining throats of fireplaces with chimneys having square flue liners require different patterns for the lines of cut than are used for chimneys having clay flue liners with a rectangular cross-sectional configuration.

A clay throat for a fireplace with a chimney having flue liners with a rectangular cross-sectional configuration is illustrated in FIGS. 2–12, and a clay throat for a fireplace with a chimney having flue liners with a square cross-sectional configuration is illustrated in FIGS. 3–23.

Clay flue liners are normally joined together end to end and extend upwardly within the chimney from the throat of the fireplace to the top of the chimney. Clay flue liners are used in the same manner with the present invention.

According to the invention, clay flue liners with a square cross-sectional configuration are cut along selected lines and portions are used to line the throat of the fireplace. The lining of the throat with portions of clay flue liners effectively joins the brick firebox to the clay flue liner in the chimney and saves the time and expense of using brick to make the throat. The resulting fireplace has the efficiency and durability of brick without the quantity and expense of brick in the throat.

Figure 1:
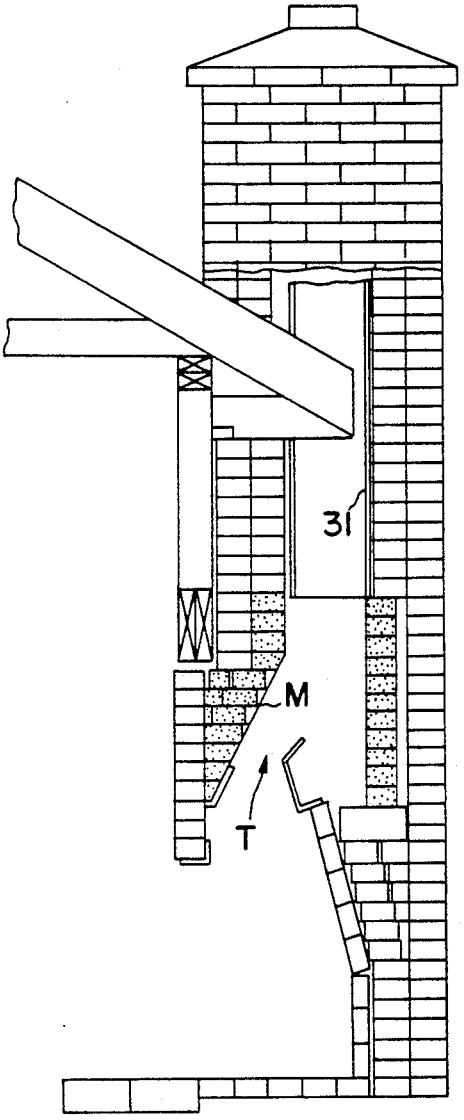
FIG.1 PRIOR ART
FIG. 1 is a side view, partially in section, of a prior art all-brick fireplace, some of the brick being marked to designate the conventional brick throat of the fireplace.

FIG. 1 shows the prior art use of brick to line the throat of a brick fireplace. The brick throat of the fireplace in FIG. 1 is broadly indicated at T and further designated by marked brick defining the outline of the throat.

The uneven surface created by the staggered brick defining the inwardly and upwardly inclined front wall of the throat is conventionally mortared to present a smooth surface, as indicated by the angularly extending straight line M in FIG. 1. Lining the throat with portions of clay flue liners eliminates the uneven surface caused by brick and eliminates the time and expense of mortaring.

THE FIRST EMBODIMENT

Figure 2A:
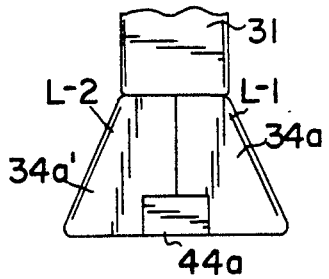
FIG. 2A is a rear view of the clay throat shown in FIG. 2.
Figure 2:
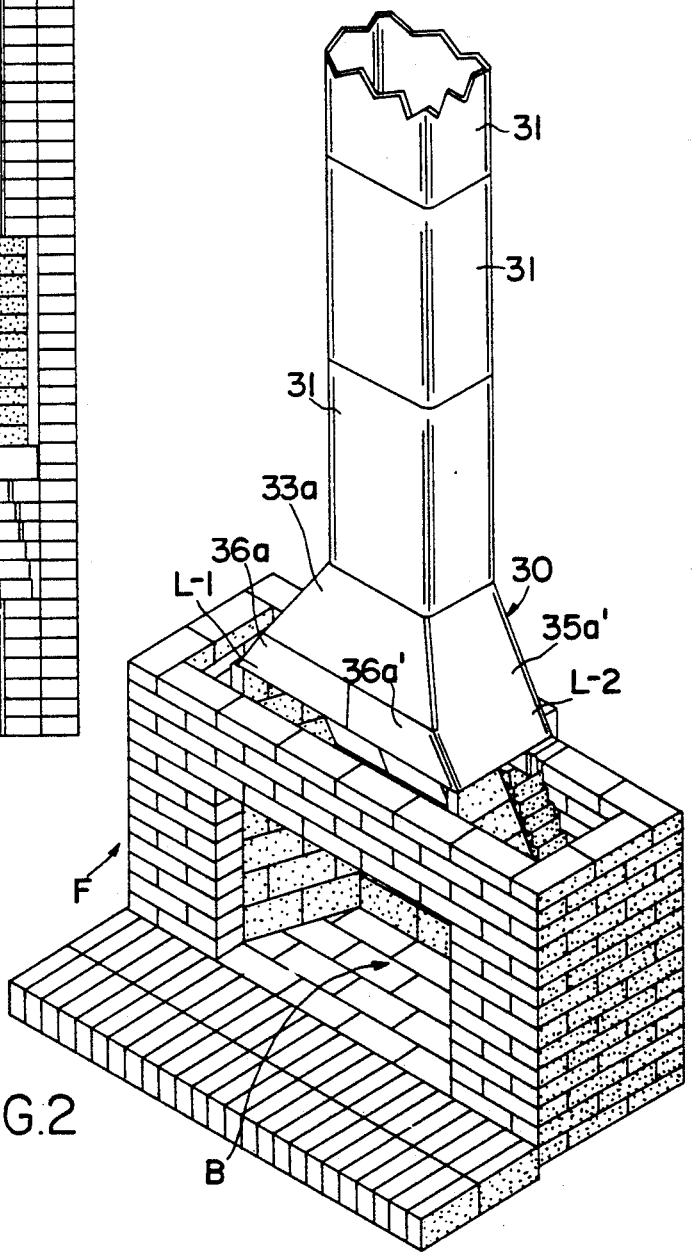
FIG. 2 is a perspective view of one embodiment of a fire-place throat lined with clay and installed in a brick fireplace according to the invention.
Figure 4:
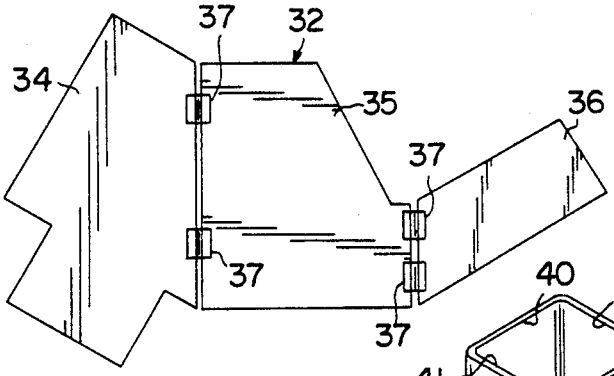
FIG. 4 is a plan view of a first template used in making the clay throat of FIG. 2.
Figure 3:
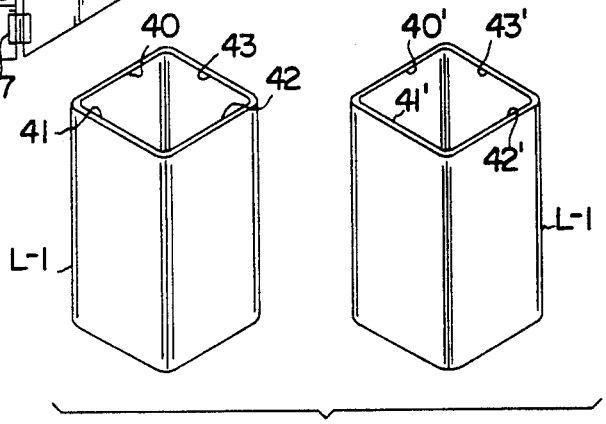
FIG.3 PRIOR ART
FIG. 3 is a perspective view of two lengths of prior art clay flue liner used in making the clay throat of FIG. 2.

Referring now to FIGS. 2–12, the fireplace in the first embodiment has a chimney with clay flue liners measuring 9×13 inches in cross section. Its clay throat is broadly indicated at 30 in FIG. 2. The throat 30 is formed with portions of two conventional clay flue liners L-1 and L-2, each measuring 13×13 inches in cross section (FIG. 3). The liners L-1 and L-2 are marked with a pattern and are cut as marked to provide selected pieces for an appropriately shaped fireplace throat. The selected pieces of liners L-1 and L-2 effectively define the inner contour of the throat and provide a smooth liner for the throat. Brick and mortar are laid against and around the outer surfaces of the clay throat 30 to complete the fireplace.

As shown in FIG. 2, the firebox B of fireplace F is constructed from brick in the usual manner. Selected pieces cut from the square-shaped flue liners L-1 and L-2 are then assembled for forming the throat 30 on top of the brick walls of the firebox B. Lengths of clay flue liner 31, having a rectangular cross-sectional configuration are joined together end-to-end within the chimney on top of the throat 30 in the usual fashion.

Figure 9:
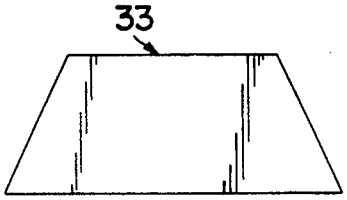
FIG. 9 is a plan view of a second template used in making the clay throat of FIG. 2.

The square-shaped flue liners L-1 and L-2 are marked with selected lines of cut by using a hinged template, broadly indicated at 32 (FIG. 4), and a planar template 33 (FIG. 9). The templates 32 and 33 have been formed and shaped to provide a pattern for marking selected lines of cut on the clay flue liners L-1 and L-2. After being cut, selected pieces of the liners L-1 and L-2 of predetermined configurations and dimensions are assembled into the configuration of the throat 30.

Figure 5:
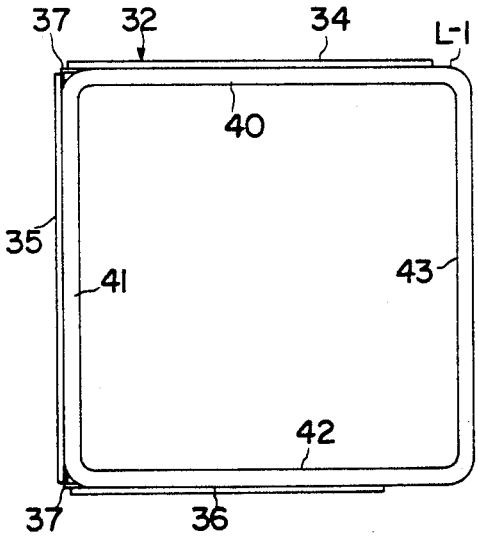
FIG. 5 is an end view of one of the clay flue liners shown in FIG. 3 with the template shown in FIG. 4 positioned about portions of three sides of the one clay flue liner to serve as a pattern for marking selected lines of cut on three sides of the one clay flue liner.
Figure 6:
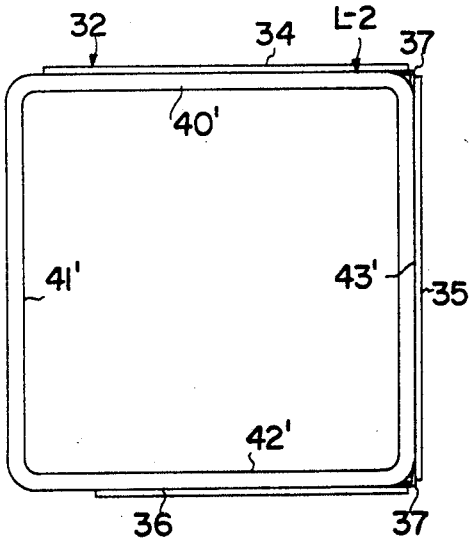
FIG. 6 is an end view of the second clay flue liner shown in FIG. 3 with the template of FIG. 4 positioned about portions of three sides of the second clay flue liner to serve as a pattern for marking selected lines of cut on three sides of the second clay flue liner.

The template 32 comprises three flat pieces 34, 35, and 36. The inner edges of the pieces 34–36 are hinged together, as by hinges 37. The outer edges of each piece are shaped to provide a pattern for cutting one side of the four-sided tubular flue liners L-1 and L-2. In actual practice, as seen in FIG. 5, the hinged template 32 is placed against three of the four sides 40, 41, 42, and 43 of clay flue liner L-1. As shown, piece 34 of template 32 overlies that part of side 40 selected to form a portion of the clay throat 30; piece 35 overlies that part of side 41 selected to form a portion of the clay throat 30; and piece 36 overlies that part of side 42 of the flue liner L-1 selected to form a portion of the clay throat 30.

After the flue liner L-1 has been marked with the selected lines of cut, the template 32 is used for similarly marking the sides $40^1$, $43^1$, and $42^1$ of flue liner L-2. Note in FIGS. 5 and 6 that the central piece 35 of the template 32 is placed against side 41 of flue liner L-1 and against the opposed side $43^1$ of flue liner L-2. The selected portions cut from the flue liners L-1 and L-2 form opposite sides of the throat 30, as best seen in FIG. 11.

Figure 7:
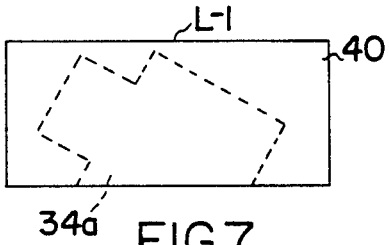
FIG. 7 is a side view looking at one side of the one clay flue liner and corresponding portion of the template shown in FIG. 5, showing in dotted lines the pattern marked for selected lines of cut with that portion of the template on the one side of the clay flue liner.
Figure 8:
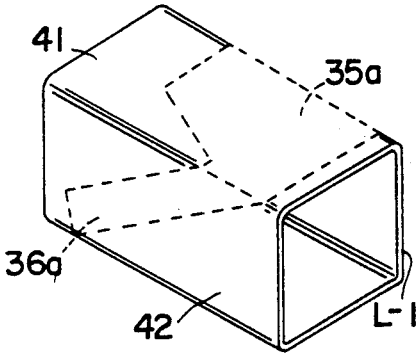
FIG. 8 is a perspective view looking at second and third sides of the one clay flue liner and corresponding portions of the template shown in FIG. 5, showing in dotted lines the patterns marked for selected lines of cut with the portions of the template on the second and third sides of the one clay flue liner.

The dotted lines in FIGS. 7 and 8 show the lines of cut marked on the clay flue liner L-1 corresponding to the pattern provided by the template 32. FIG. 7 shows side 40 of flue liner L-1 marked with dotted lines of cut to form portion 34A of the throat 30. FIG. 8 shows side 41 of flue liner L-1 marked with dotted lines of cut to form portion 35A of the throat 30. FIG. 8 also shows side 42 of flue liner L-1 marked with dotted lines of cut to form portion 36A of the throat 30 (see FIGS. 2, 2A, 11 and 12).

Figure 10:
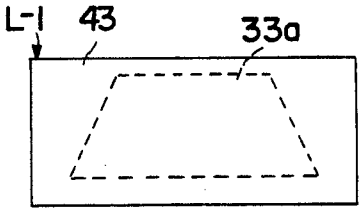
FIG. 10 is a plan view of the second template positioned on the fourth side of the one clay flue liner shown in FIG. 5, and showing in dotted lines the pattern for selected lines of cut defined by the second template.
Figure 12:
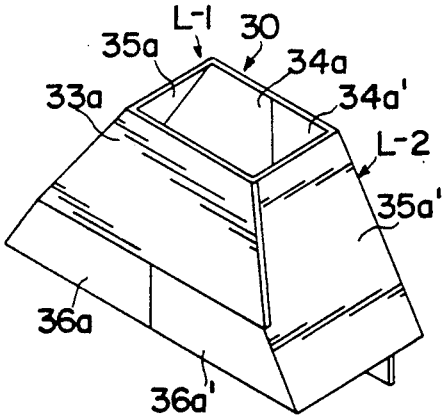
FIG. 12 is a perspective view of the clay throat shown in FIG. 2 removed from the fireplace.
Figure 11:
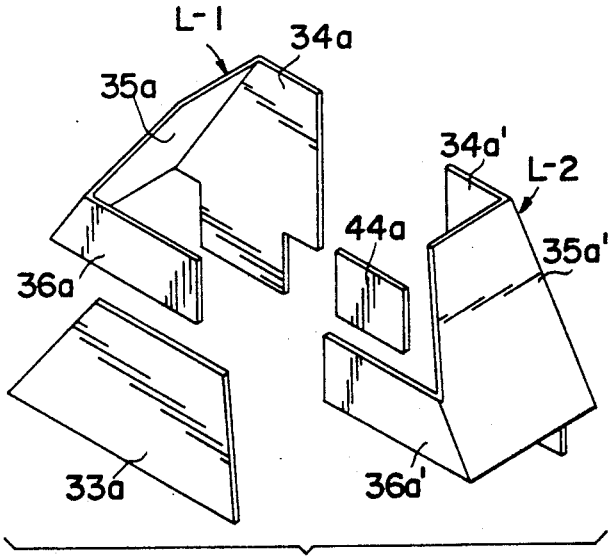
FIG. 11 is an exploded perspective view of selected pieces cut from the two clay flue liners of FIG. 3 assembled to form the clay throat shown in FIG. 2.

FIG. 10 shows side 43 of clay flue liner L-1 marked with dotted lines of cut made by using the template 33 of FIG. 9 to form piece 33A of the throat 30 (see FIGS. 11 and 12).

Figure 9A:
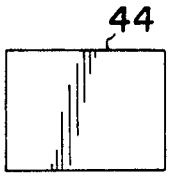
FIG. 9A is a plan view of a third template used in making the clay throat of FIG. 2.
Figure 10A:
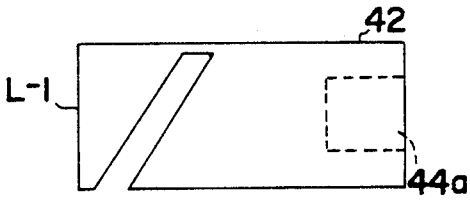
FIG. 10A is a plan view showing a third template positioned on the third side of the one clay flue liner shown in FIG. 5, and showing in dotted lines the pattern for selected lines of cut defined by the third template.

A third template 44 (FIG. 9A) provides a pattern for a small rectangular piece 44A to fill the space between the lowermost portions of the rear pieces 34A and 34A[1] of the throat 30 (FIGS. 2A and 11). As shown in FIG. 10A, the pattern 44 is placed in overlying relation against the uncut end of side 42 of flue liner L-1 and a line of cut, indicated by dotted lines, is formed for piece 44A of the throat 30.

THE SECOND EMBODIMENT

Figure 13:
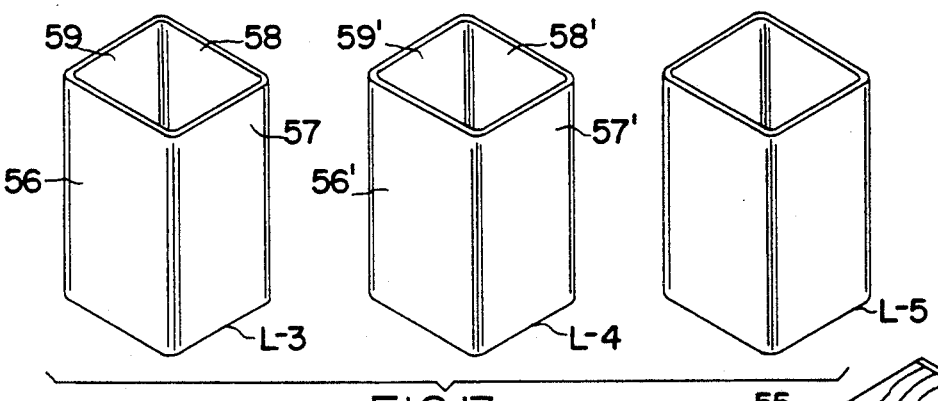
FIG.13 PRIOR ART
FIG. 13 is a perspective view of three lengths of prior art clay flue liner used in making a second embodiment of the clay throat.
Figure 15:
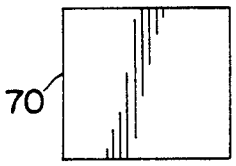
FIG. 15 is a plan view of a second template used in making the second embodiment of the clay throat.
Figure 14:
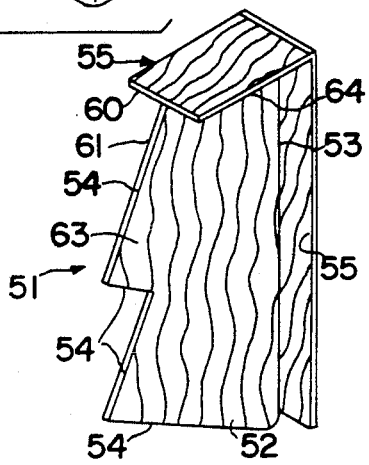
FIG. 14 is a perspective view of a first template used in making the second embodiment of the clay throat.

The second embodiment is illustrated in FIGS. 13–23. The fireplace in the second embodiment has a chimney with clay flue liners measuring 13×13 inches in cross section. Its clay throat is broadly indicated at 50 in FIG. 23. The throat 50 is lined with portions from three lengths of clay flue liner L-3, L-4, and L-5 (FIG. 13). Each of the clay flue liners in FIG. 13 is two feet long and has a square cross-sectional configuration measuring 13×13 inches.

A template 51 (FIG. 14) comprises a body 52 configured with a right angular inner edge 53 and an irregular outer edge 54. The inner edge 53 is covered by a flange 55 extending perpendicularly outwardly beyond opposed sides of the body 52. The irregular outer edge 54 is shaped as a pattern to mark selected lines of cut on two opposed sides of the liners L-3 and L-4.

The clay throat 50 is formed from sides 57, 58, and 59 of the clay flue liner L-3; sides 56[1], 57[1], and 59[1] of the clay flue liner L-4; and all four sides of the clay flue liner L-5. Lines of cut are selected on sides 57 and 59 of the liner L-3 and on sides 57[1] and 59[1] of the liner L-4 by positioning the template 51 sequentially against these sides.

Figure 16:
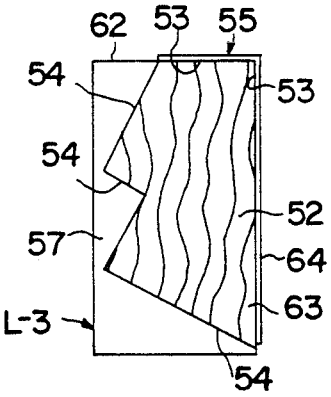
FIG. 16 is a side view of one of the clay flue liners shown in FIG. 13, illustrating how the template of FIG. 14 is sequentially positioned against two opposed sides of two of the clay flue liners of FIG. 13 as a pattern for marking selected lines of cut on the two clay flue liners.

The flange 55 on the template facilitates proper positioning of the template against the sides of the liners. One side 60 of the flange 55 and the corresponding side 61 of the body 52 conform respectively with end 62 and side 57 of liner L-3, as shown in FIG. 16. The irregular outer edge 54 of the template 51 is thus properly and easily positioned against the side 57 of the liner L-3 to provide a pattern for marking a selected line of cut on the side 57. After the side 57 of the liner L-3 is marked according to the pattern of the template edge 54, the opposite side 63 of the body 52 and opposite side 64 of the flange of the template 51 are positioned against side 59 of the liner L-3, opposite the side 57, and the side 59 of liner L-3 is correspondingly marked for cutting.

Figure 17:
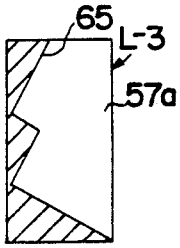
FIG. 17 is a side view of the one clay flue liner shown in FIG. 16 after it has been cut along the selected lines of cut defined by the template, showing with hatching the part of the clay flue liner that has been cut away and removed.
Figure 19:
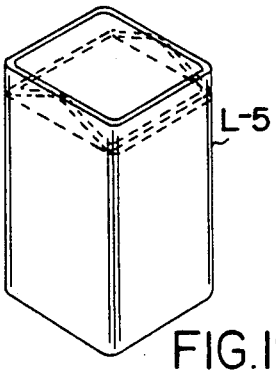
FIG. 19 is a perspective view of the third clay flue liner shown in FIG. 13, illustrating with dotted lines how the third clay flue liner is measured and marked for cutting along selected lines of cut.

The sides 57 and 59 are cut with a masonry saw along the line 65 in FIG. 17 and the part of liner L-3 represented by the hatched area of FIG. 17 is cut away and removed. The portion cut from liner L-3 and selected for the clay throat 50 comprises the remaining portion of its sides 57 and 59, indicated at 57A in FIG. 17, and all of the intervening side 58 of liner L-3. The just described portion of liner L-3 in the clay throat 50 is broadly designated at L-3A in FIGS. 22 and 23.

Figure 18:
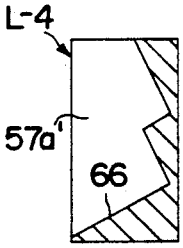
FIG. 18 is a side view of a second clay flue liner shown in FIG. 13 after it has been cut along the selected lines of cut defined by the template, showing with hatching the part of the clay flue liner that has been cut away and removed.

FIG. 18 illustrates use of the template 51 to mark the sides 57[1] and 59[1] of the clay flue liner L-4. The sides 57[1] and 59[1] are cut with a masonry saw along the line 66 in FIG. 18 and the part of liner L-4 represented by the hatched area of FIG. 18 is cut away and removed. The portion cut from liner L-4 and selected for the clay throat 50 comprises the remaining portion of its sides 57[1] and 59[1], indicated at 57A[1] in FIG. 18, and all of the intervening side 56[1] of liner L-4. The just described portion of liner L-4 in the clay throat 50 is broadly designated at L-4A in FIGS. 22 and 23.

Figure 21:
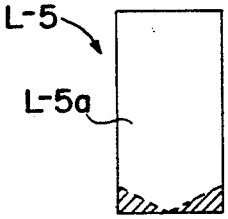
FIG. 21 is a plan view showing the template of FIG. 15 positioned on the portion of the liner shown in FIG. 18 that was cut away and removed, and showing in dotted lines the pattern for selected lines of cut defined by the template of FIG. 15 and showing with hatching the part of that portion of the clay flue liner that has been cut away and removed.
Figure 21:
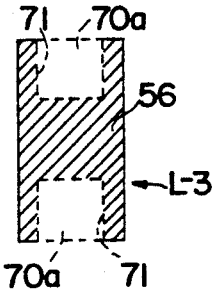
Figure 23:
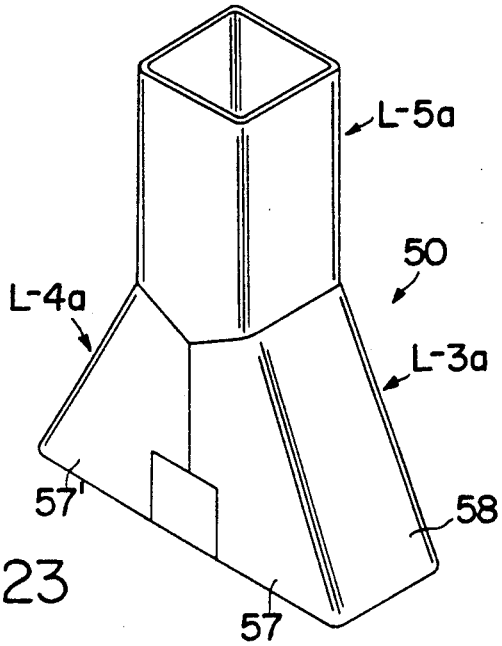
FIG. 23 is a perspective view of the second embodiment of the clay throat.
Figure 22:
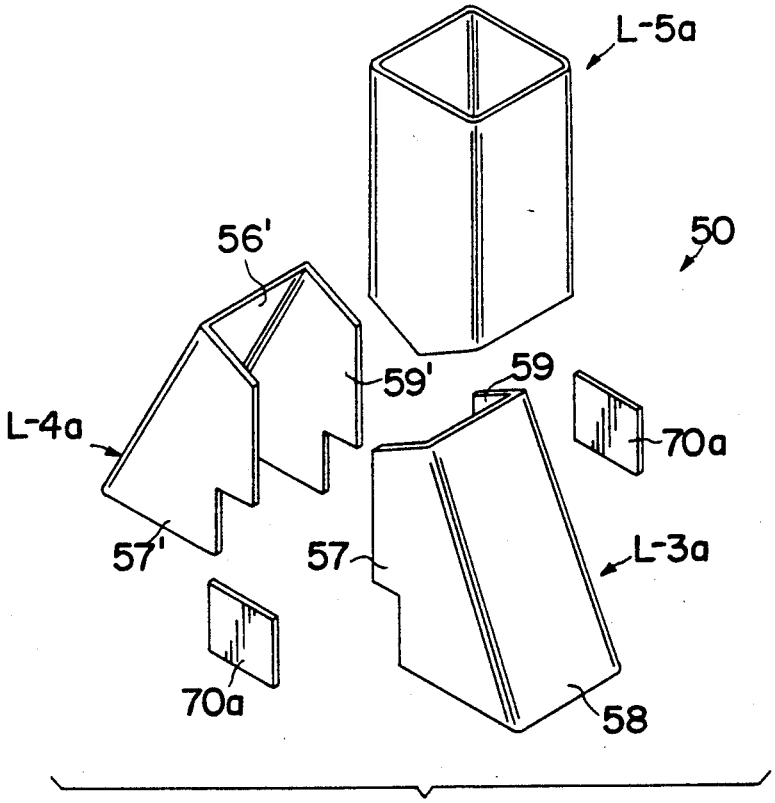
FIG. 22 is an exploded perspective view of selected pieces cut from the three clay flue liners of FIG. 13 assembled to form the second embodiment of the clay throat.

A square template 70 (FIG. 15) is used as a pattern for cutting correspondingly shaped pieces 70A from the side 56 of the clay flue liner L-3, for example. FIG. 21 shows side 56 of the clay flue liner L-3 after using the template 70 to mark a pattern along the lines 71 for cutting with a masonry saw. The part represented by the hatched area of FIG. 21 is cut away and removed. The remaining pieces 70A are used to fill the spaces between the portions L-3A and L-4A at the front and rear of the clay throat 50.

The clay throat 50 is completed by cutting clay flue liner L-5 to form portion L-5A and installing portion L-5A on top of portions L-3A and L-4A. The lines of cut required to shape the liner L-5 into portion L-5A of the clay throat 50 are shown in dotted lines in FIG. 19.

The pattern for the lines of cut is made by drawing a line around the liner L-5 3¼ inches (8.26 cm) from one of its ends and establishing the centers of opposed sides of the liner L-5. Lines are then drawn from the centers of opposed sides to the ends of the lines on opposed sides, as indicated by the angular dotted lines in FIG. 19. The liner L-5 is then cut with a masonry saw along the dotted lines in FIG. 19. The hatching in FIG. 20 shows the portion that is cut away and removed. The portion marked L-5A in FIG. 20 becomes portion L-5A of the clay throat 50.

There is thus provided an effective and durable clay throat for a fireplace and a cost effective process for creating and installing it.

I claim:

1. A fireplace having a brick firebox and a brick chimney lined with individual lengths of clay flue liner of a uniform dimension and a throat tapering upwardly and inwardly from the brick firebox to the clay flue liner in the brick chimney, wherein the improvement comprises said throat being formed of portions of at least two lengths of clay flue liner that initially correspond dimensionally to the lengths of clay flue liner to be used in the chimney but are cut to specific shapes and interfitted to define the throat tapering upwardly and inwardly from the brick firebox.

2. A fireplace according to claim 1 wherein the cross-sectional dimensions of the clay throat at its juncture with the brick firebox correspond to the adjoining cross-sectional dimensions of the brick firebox and the cross-sectional dimensions of the clay throat at its juncture with the clay flue liner correspond to the adjoining cross-sectional dimensions of the clay flue liner.

3. A fireplace according to claim 1 wherein the portions are cut on the side of the fireplace from conventional lengths of clay flue liners according to a pattern.

4. A fireplace according to claim 3 wherein the pattern comprises a template.

5. A process of making a fireplace with a brick firebox and a throat formed from a plurality of clay flue lines, said process comprising the steps of:

(a) building the brick fireplace;

(b) providing lengths of clay flue liner of a selected size for the flue of the fireplace;

(c) providing additional lengths of clay flue liner of said selected size for forming the throat of the fireplace;

(d) cutting the additional lengths of clay flue liner into selected pieces to form the throat of the fireplace; and (e) assembling the selected pieces of clay flue liner and joining them together on top of the firebox to define the throat of the fireplace.

6. A process according to claim 5 wherein at least one pattern is provided for cutting the additional lengths of clay flue liner into selected pieces.

7. A process according to claim 5 wherein the pattern comprises a template.

8. A template for use as a pattern to mark selected lines of cut on conventional clay flue liners preliminary to cutting the clay flue liners along the selected lines of cut to provide portions of the clay flue liners in a predetermined configuration for assembly and joining together into a clay throat of a fireplace, said template comprising a pattern edge against which lines may be drawn on the clay flue liners to designate selected lines of cut, and means for locating the pattern edge of the template over those portions of the clay flue liners to be marked for the selected lines of cut.

9. A template according to claim 8 wherein the means for locating the pattern edge of the template over those portions of the clay flue liners to be marked for the selected lines of cut comprises three articulated pieces forming the template and each piece including an inner edge hinged to another piece of the template and an outer edge forming a portion of the pattern edge of the template, whereby the three piece template may be wrapped around three sides of a length of clay flue liner to simultaneously locate the pattern for marking all sides of the liner to be cut according to the pattern of the template.

10. A template according to claim 8 wherein the means for locating the pattern edge of the template over those portions of the clay flue liners to be marked for the selected lines of cut comprises a body having the pattern edge, and a right angular flange extending perpendicularly from the body, whereby the template is positioned against a clay flue liner with the flange overlying one end and a portion of one side of the clay flue liner to position the body of the template against an adjoining side of the clay flue liner with its pattern edge extending along portions of the clay flue liner to be marked for the selected lines of cut.

11. A template according to claim 10 wherein the right angular flange extends perpendicularly from both sides of the body, whereby the template may be used to designate corresponding lines of cut on opposed sides of a clay flue liner.

* * * * *